US007032783B1

(12) United States Patent
Kamp et al.

(10) Patent No.: US 7,032,783 B1
(45) Date of Patent: Apr. 25, 2006

(54) PUMP DISPENSER FOR LIQUID PRODUCTS

(75) Inventors: David C. Kamp, Grand Rapids, OH (US); Raymond C. Lewis, Jr., Toledo, OH (US); Richard D. Lohrman, Sylvania, OH (US); Thomas P. Royce, Swanton, OH (US); Gennaro R. Martire, Perrysburg, OH (US)

(73) Assignee: Continentalafa Dispensing Company, St. Peters, MO (US)

( * ) Notice: Subject to any disclaimer, the term of this patent is extended or adjusted under 35 U.S.C. 154(b) by 623 days.

(21) Appl. No.: 10/146,325

(22) Filed: May 14, 2002

(51) Int. Cl.
*B65D 88/54* (2006.01)

(52) U.S. Cl. ..... 222/321.9

(58) Field of Classification Search ..... 222/321.9
See application file for complete search history.

(56) References Cited

U.S. PATENT DOCUMENTS 3,229,864 A * 1/1966 Roder ..... 222/321.7
3,362,344 A * 1/1968 Duda ..... 222/321.9

* cited by examiner

*Primary Examiner*—Philippe Derakshani
(74) *Attorney, Agent, or Firm*—Thompson Coburn, LLP

(57) ABSTRACT

A pump dispenser for liquid products includes a pump chamber having a cylinder, and a piston slidable within the cylinder with an outlet passage extending through the piston. A spring within the chamber urges the piston to an extended position. An inlet opening is disposed at an end of the chamber for receiving product to be dispensed. An inlet check valve is positioned at the inlet opening to permit entry of product into the chamber as the piston is extended by the spring, but to prevent exit of product from the chamber through the inlet opening as the piston is depressed against the spring. An outlet check valve is carried by the piston within the outlet passage to permit discharge of product from the chamber through the outlet passage as the piston is depressed against the spring. The outlet valve includes a concave valve body of flexible resilient construction opening away from the chamber and having an external periphery in radial surface-to-surface resilient sealing contact with an opposing radially inwardly facing wall surface of the outlet passage.

65 Claims, 7 Drawing Sheets

PUMP DISPENSER FOR LIQUID PRODUCTS

The present invention is directed to finger-type pump dispensers for liquid products such as body lotions, and more particularly to improvements in the inlet valve and/or the outlet valve construction in pump dispensers of this type.

BACKGROUND AND SUMMARY OF THE INVENTION

U.S. Pat. No. 6,053,371 discloses a finger-type pump dispenser for liquid products such as body lotions. A pump chamber includes a cylinder, and a piston slidable within the cylinder and having an outlet passage extending through the piston. A spring is disposed within the chamber to urge the piston to an extended position. An inlet opening at a lower end of the chamber receives product to be dispensed. An inlet valve ball cooperates with a valve seat at the inlet opening of the chamber to permit entry of product into the chamber as the piston is extended by the spring, but to prevent exit of product from the chamber through the inlet opening as the piston is manually depressed against the spring. An outlet valve ball is carried by the piston within the outlet passage to permit discharge of product from the chamber as the piston is manually depressed against the spring, but to prevent entry of air into the chamber through the outlet passage as the piston is extended by the spring. It is a general object of the present invention to provide improvements in construction of the inlet valve and/or the outlet valve in pump dispensers of this type.

The present invention embodies a number of different aspects, which may be used separately from or more preferably in combination with each other.

In accordance with a first aspect of the present invention, a pump dispenser for liquid products includes a pump chamber having a cylinder, and a piston slidable within the cylinder with an outlet passage extending through the piston. A spring within the chamber urges the piston to an extended position. An inlet opening is disposed at an end of the chamber for receiving product to be dispensed. An inlet check valve is positioned at the inlet opening to permit entry of product into the chamber as the piston is extended by the spring, but to prevent exit of product from the chamber through the inlet opening as the piston is depressed against the spring. An outlet check valve is carried by the piston within the outlet passage to permit discharge of product from the chamber through the piston outlet passage as the piston is depressed against the spring. The outlet check valve includes a concave valve body of flexible resilient construction opening away from the chamber and having an external periphery in radial surface-to-surface resilient sealing contact with an opposing inwardly radially facing wall surface of the outlet passage surrounding the valve.

A pump dispenser for liquid products in accordance with a second aspect of the invention includes a pump chamber with a cylinder, and a piston slidable within the cylinder and having an outlet passage extending through the piston. An inlet opening at an end of the chamber receives product to be dispensed, and a spring is disposed within the chamber urging the piston to an extended position. An inlet check valve at the inlet opening permits entry of product into the chamber as the piston is extended by the spring, but prevents exit of product from the chamber through the inlet opening as the piston is depressed against the spring. An outlet check valve is carried by the piston within the outlet passage to permit discharge of product from the chamber through the piston outlet passage as the piston is depressed against the spring. At least one of the inlet and outlet check valves is in the form of a valve cartridge assembly disposed in the outlet passage. The valve cartridge assembly includes a collar having a valve seat surface and a valve element captured within the collar for sealing engagement with the valve seat surface. In accordance with one embodiment of this aspect of the invention, the outlet check valve includes a concave outlet valve of flexible resilient construction that is molded into the collar. In another embodiment of this aspect of the invention, the outlet check valve comprises a valve ball that is captured within the collar and cooperates with a valve ball seat at one end of the collar.

In accordance with yet another aspect of the present invention, a pump dispenser for liquid products includes a pump chamber having a cylinder, and a piston slidable within the cylinder and having an outlet passage extending through the piston. An inlet opening at an end of the chamber receives product to be dispensed, and a spring within the chamber urges the piston to an extended position. An inlet check valve at the inlet opening permits entry of product into the chamber as the piston is extended by the spring, but prevents exit of product from the chamber through the inlet opening as the piston is depressed against the spring. An outlet check valve is carried by the piston within the outlet passage to permit discharge of product from the chamber through the piston outlet passage as the piston is depressed against the spring. The inlet valve includes a concave valve body of flexible resilient construction opening into the chamber and having a periphery in radial surface-to-surface resilient sealing contact with an opposing radially inwardly facing surface of the inlet opening.

A pump dispenser for liquid products in accordance with another aspect of the invention includes a pump chamber with a cylinder, and a piston slidable within the cylinder and having an outlet passage extending through the piston. An inlet opening at an end of the chamber receives product to be dispensed, and a spring within the chamber urges the piston to an extended position. An inlet check valve at the inlet opening permits entry of product into the chamber through the inlet opening as the piston is extended by the spring, but prevents exit of product from the chamber through the inlet opening as the piston is depressed against the spring. An outlet check valve is carried by the piston within the outlet passage to permit discharge of product from the chamber through the piston outlet passage as the piston is depressed against the spring. The outlet check valve is of flexible resilient construction and is molded onto the body of the piston.

A pump dispenser for liquid products in accordance with a further aspect of the invention includes a pump chamber having a cylinder, and a piston slidable within the cylinder and having an outlet passage extending through the piston. An inlet opening at an end of the chamber receives product to be dispensed, and a spring within the chamber urges the piston to an extended position. An inlet check valve at the inlet opening permits entry of product into the chamber through the inlet opening as the piston is extended by the spring, but prevents exit of product from the chamber through the inlet opening as the piston is depressed the spring. An outlet check valve is carried by the piston within the outlet passage to permit discharge of product from the chamber through the piston outlet passage as the piston is depressed against the spring. The inlet valve includes a valve ball and a valve seat at the inlet opening. The outlet valve is of flexible resilient construction, and has a finger extending into the chamber for engaging the inlet valve ball and holding the inlet valve ball against the seat in a fully depressed position of the piston against the spring.

A pump dispenser for liquid products in accordance with another aspect of the invention includes a pump chamber with a cylinder, and a piston slidable within the cylinder and having an outlet passage extending the piston. An inlet opening at an end of the chamber receives product to be dispensed, and a spring within the chamber urges the piston to an extended position. An inlet check valve at the inlet opening permits entry of product into the chamber through the inlet opening as the piston is extended by the spring, but prevents exit of product from the chamber through the inlet opening as the piston is depressed against the spring. An outlet check valve is carried by the piston within the outlet passage to permit discharge of product from the chamber through the piston outlet passage as the piston is depressed against the spring. The outlet valve includes a collar for surrounding the inlet valve ball in the fully depressed position of the piston against the spring, both to hold the valve ball in position against its seat and to reduce the open volume of the chamber.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
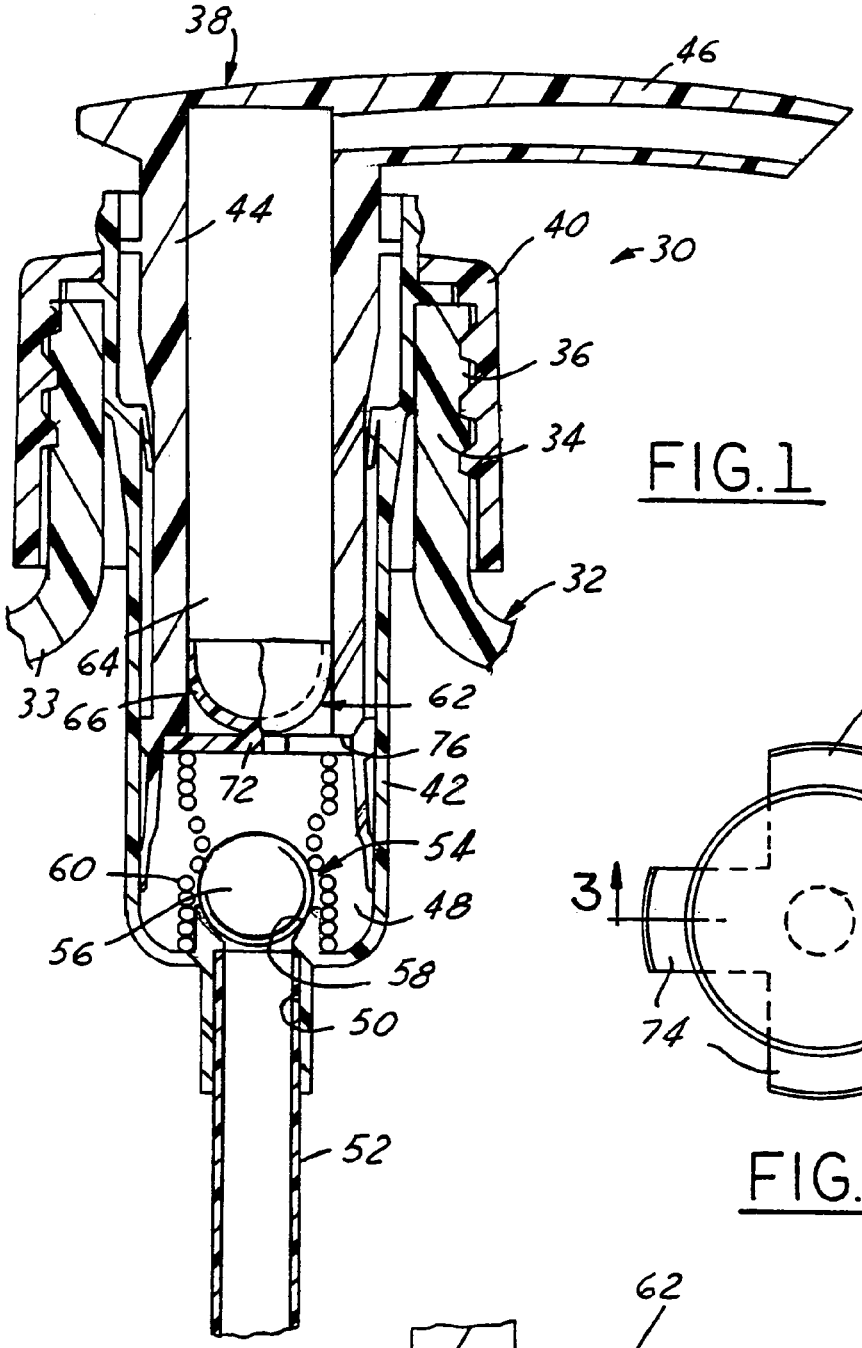
FIG. 1 is a sectioned elevational view of a package that includes a pump dispenser in accordance with one presently preferred embodiment of the invention.

FIG. 1 illustrates a package 30 in accordance with one presently preferred embodiment of the invention as comprising a container 32 having a body 33 for holding a liquid product to be dispensed and a finish 34 surrounding and defining an outlet opening. Finish 34 has one or more external threads or beads 36 for securing a closure. A pump dispenser 38 is secured to finish 34 of container 32 by a closure 40. Pump dispenser 38 includes a cylinder 42 suspended within the container finish, and a piston 44 slidably disposed within cylinder 42. Piston 44 has a nozzle 46 with an internal passage for dispensing product. Nozzle 46 may be integral with piston 44 as shown, or may be separately formed and assembled to the piston. A pump chamber 48 is defined between cylinder 42 and the lower end of piston 44. (Descriptive words such as "upper" and "lower" are employed by way of description and not limitation with reference to the upright orientation of the pump dispenser and package illustrated in the drawings. Descriptive words such as "radial" and "axial" are employed by way of description and not limitation with reference to the central axis of pump dispenser 38, which is preferably coaxial with cylinder 42 and container finish 34.) Cylinder 42 has an inlet opening 50 that extends from the lower end of chamber 48 and connects to a dip tube 52 for drawing liquid product from within container body 33. An inlet check valve 54 is defined by a valve ball 56 and an opposed valve seat 58 surrounding inlet opening 50. A coil spring 60 is captured in compression within chamber 48 between the lower end of cylinder 42 and an opposing portion of piston 44. An outlet check valve 62 is disposed within outlet passage 64 of piston 38. In general, as piston 44 is moved downwardly into cylinder 42 and chamber 48 against the force of spring 60, liquid product within chamber 48 flows upwardly past outlet valve 62 into outlet passage 64 of piston 44. In the meantime, valve ball 56 of inlet valve 54 is held against seat 58 to prevent egress of fluid from chamber 48 into inlet opening 50 and dip tube 52. When pump piston 44 is released, the piston is returned to its extended position under the force of spring 60. This movement of piston 44 draws liquid into chamber 48 through dip tube 52 and inlet opening 50. In the meantime, outlet valve 62 prevents ingress of air and backflow of liquid from outlet passage 62. FIG. 1 (and FIGS. 6, 15 and 18–19) shows the piston in the fully depressed position into chamber 48 against spring 60. This is the position in which the package is shipped and stored. Coil spring 60 is contoured to hold valve ball 56 against seat 58 in the fully depressed position of piston 44, so that package 30 can be inverted during shipping and storage without loss of product from the container body.

Figure 2:
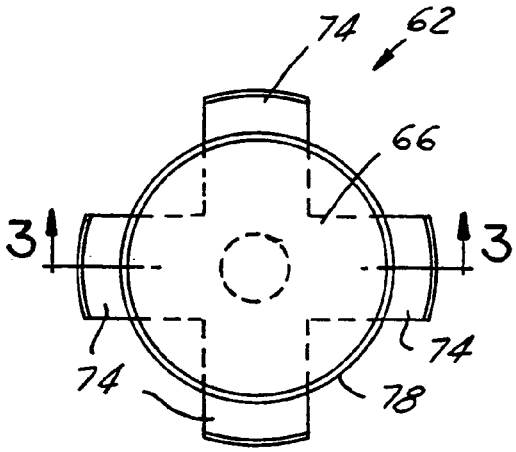
FIG. 2 is a top plan view of the outlet check valve in the dispenser of FIG. 1.
Figure 3:
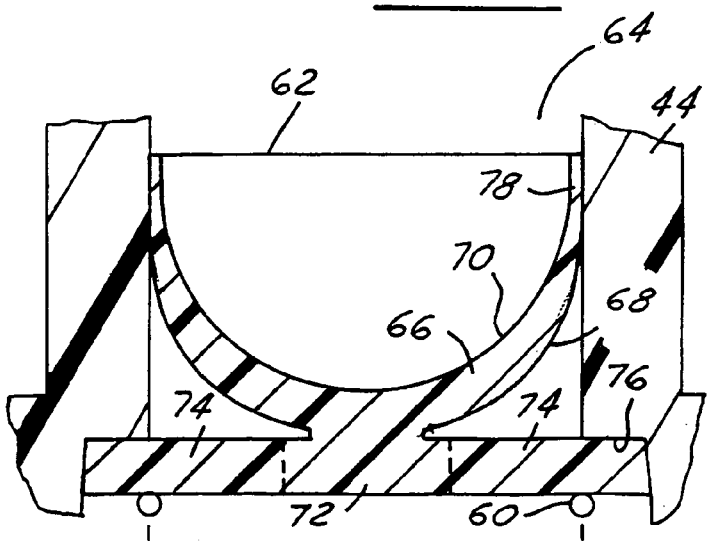
FIG. 3 is a sectional view taken substantially along the line 3—3 in FIG. 2 showing the valve within the dispenser piston.

FIGS. 2 and 3 illustrate outlet check valve 62 in accordance with the embodiment of the invention illustrated in FIG. 1. Check valve 62 includes an upwardly concave tulip-shaped valve body 66 of flexible resilient construction. Valve body 66 has a rounded convex outer surface 68 and a concave inner surface 70. Surfaces 68, 70 are such that the cross sectional thickness of valve body 66 decreases or tapers from the center of the valve body radially outwardly to a minimum thickness at the outer peripheral edge of the valve body. Valve body 66 is integral with a base 72, which includes four radially extending legs 74 in the embodiment of FIGS. 2–3. The areas between radial legs 74 are open to permit passage of liquid product between legs 74 and then upwardly past valve body 66. The outer edges of legs 74 rest on a shoulder 76 within piston 44 facing in the direction of chamber 48 (FIG. 1). Valve 62 is held against shoulder 76 by the force of coil spring 60, which engages the undersurface of base 72. Valve 62, including valve body 66 and base 72, is of integrally molded flexible resilient construction, preferably plastic such as polyethylene. The outer periphery 78 of valve body 66 is in radial surface-to-surface contact with the surrounding radially inwardly facing surface, preferably a cylindrical inner surface, of outlet passage 64 in piston 44. As piston 44 is depressed into chamber 48 (FIG. 1), fluid flowing from chamber 48 past valve legs 74 pushes periphery 78 of valve body 66 radially inwardly, and the liquid passes the valve body into outlet passage 64. When the force of such fluid flow is removed, periphery 78 of valve body 66 returns to sealing engagement with the opposed surface of passage 64 to prevent return of such fluid to chamber 48. It will be noted in FIG. 3 that periphery 78 of valve body 66 is in opposed radial sealing contact with the inner surface of passage 64 over a substantial axial dimension, as distinguished from line contact around the outer edge of the valve body. This configuration of valve 62 provides improved sealing engagement with the surrounding seating surface of outlet passage 64.

Figure 4:
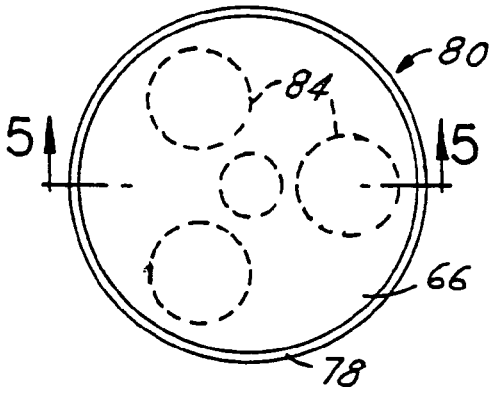
FIG. 4 is a top plan view of a modified embodiment to the outlet check valve illustrated in FIG. 1.
Figure 5:
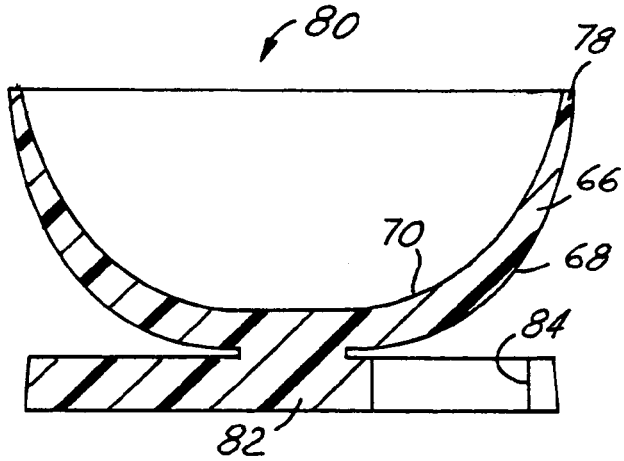
FIG. 5 is a sectional view taken substantially along the line 5—5 in FIG. 4.

FIGS. 4–5 illustrate a modified outlet check valve 80. Check valve 80 differs from check valve 62 (FIGS. 2 and 3) primarily in that base 82 of valve 80 is in the form of a circular disk having as plurality of openings 84 extending through the disk for permitting flow of fluid through the base.

Figure 6:
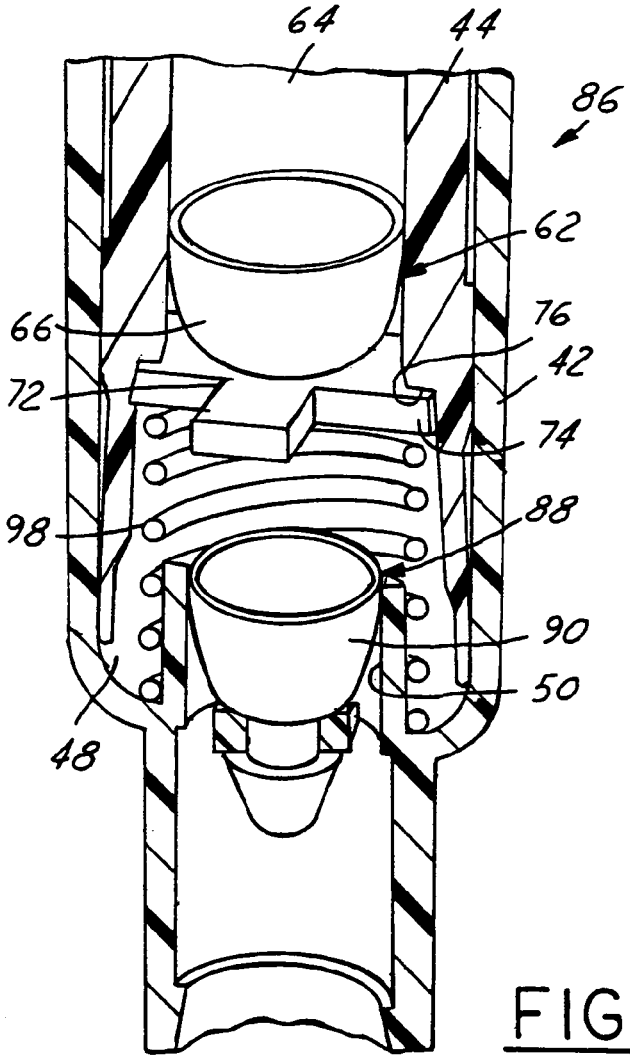
FIG. 6 is a sectioned elevational view of a pump dispenser illustrating a modification to the inlet valve arrangement in FIG. 1.
Figure 7:
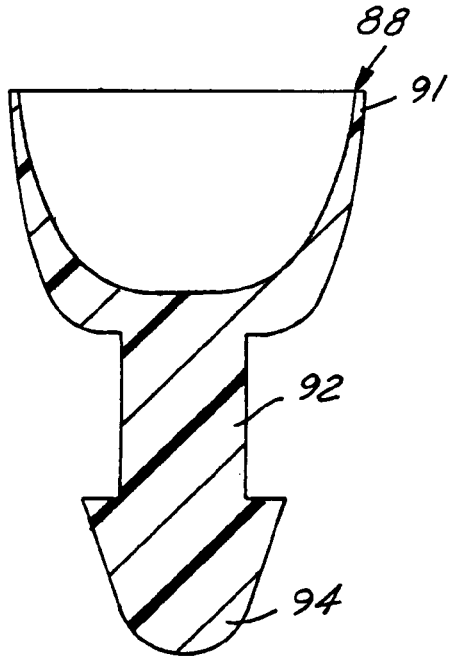
FIG. 7 is a sectioned elevational view of the inlet valve in the dispenser of FIG. 6.
Figure 8:
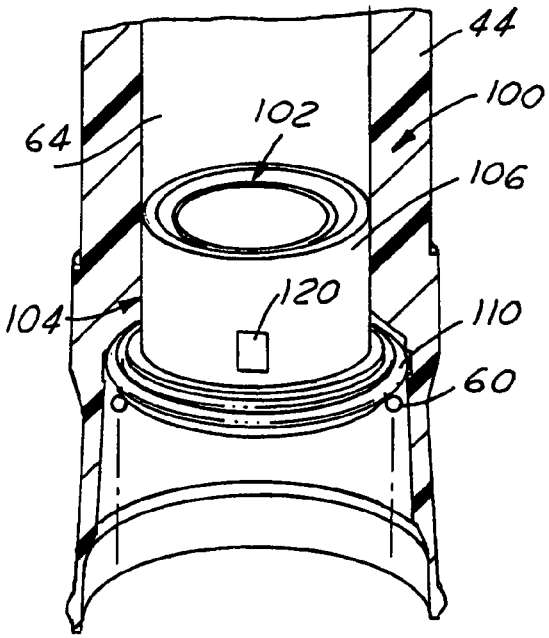
FIG. 8 is a fragmentary partially sectioned perspective view of the lower portion of the piston in the dispenser of FIG. 1, but with another modified embodiment of the outlet check valve.
Figure 9:
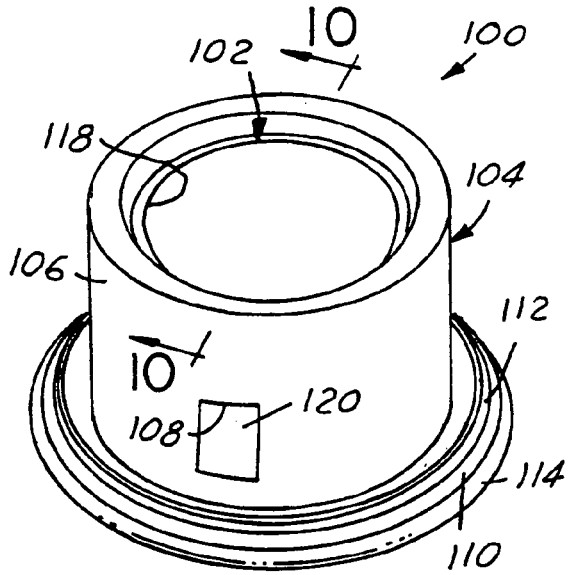
FIG. 9 is a perspective view of the outlet check valve of FIG. 8.
Figure 10:
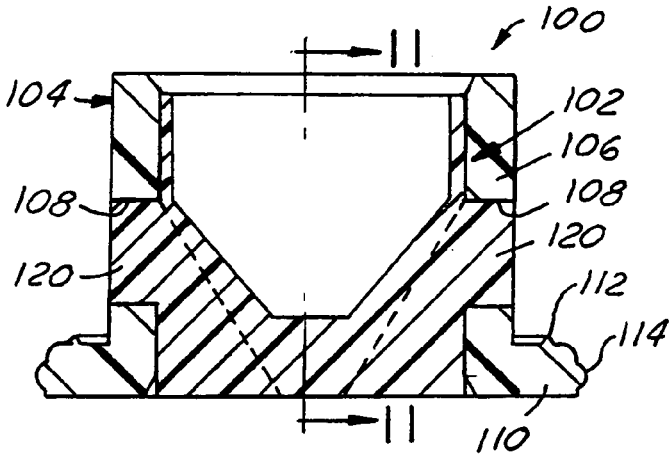
FIG. 10 is a sectional view taken substantially along the line 10—10 in FIG. 9.
Figure 11:
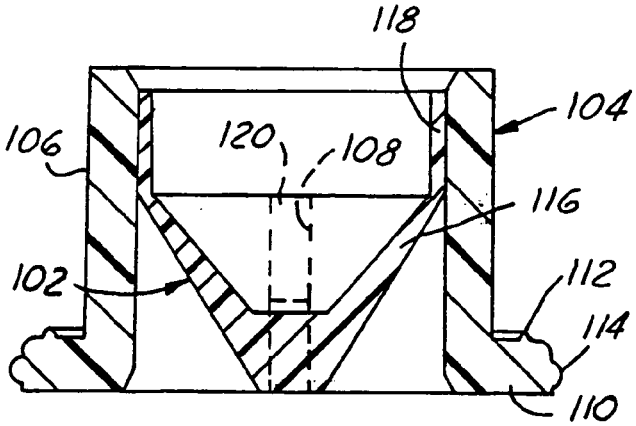
FIG. 11 is a sectional view taken substantially along the line 11—11 in FIG. 10.

FIGS. 6 and 7 illustrate a pump dispenser 86 that includes a modified inlet valve 88. (Reference numerals in FIGS. 6–7, and in FIGS. 8–20, that are identical to reference numerals employed in earlier figures indicate identical or closely related components.) Inlet valve 88 in FIGS. 6 and 7 comprises an upwardly concave tulip-shaped valve body 90 having an axially extending base 92 terminating in an enlarged lug 94. Lug 94 is press fitted through an opening in a bridge 96 (FIG. 6) that extends across inlet opening 50 at the lower end of cylinder 42. Lug 94 and base 92 are molded integrally with body 90 of valve 88, again of flexible resilient material, preferably plastic. The periphery of valve body 90 is in opposed sealing surface-to-surface contact with the surrounding surface of inlet opening 50. The cross sectional thickness of valve body 90 decreases outwardly from the center, to a minimum thickness at peripheral edge 91. Depression of piston 44 into chamber 48 improves the sealing of valve body 90 with inlet passage 50 to prevent reverse flow of fluid through inlet opening 50. On the other hand, as piston 44 is extended from chamber 48 under the force of spring 60, liquid product is free to flow past inlet valve 88 into chamber 48. The use of tulip-shaped inlet valve 88 in place of valve ball 56 and ball seat 58 in FIG. 1 not only eliminates the ball from the assembly together with the requirement for an accurately molded ball seat, but also allows the package to be inverted and remain sealed at the inlet and outlet valves while using a simple coil spring 98 in place of the contoured coil spring 60 in FIG. 1. Although the surfaces surrounding tulip-shaped valves 62, 88 preferably are cylindrical, flexible resiliency of the valve bodies accommodates minor variations from the preferred cylindrical contour without loss of sealing function.

FIGS. 8–11 illustrate a modification to the embodiment of FIG. 1, in which the outlet valve takes the form of a cartridge subassembly 100. Valve cartridge subassembly 100 includes a flexible resilient tulip-type valve 102 molded into a surrounding collar 104. Collar 104 has an axially extending cylindrical wall 106 with a pair of diametrically opposed openings 108. A flange 110 extends radially outwardly from wall 106, preferably from one end of the wall. Flange 110 has an axially facing circumferentially continuous bead 112 for opposed axial sealing engagement with shoulder 76 (FIG. 1) of piston 44, and a radially outwardly facing circumferentially continuous bead 114 for radial sealing against the opposing surface of piston 44. Valve 102 includes a valve body having a conical inner portion 116 and a cylindrical outer portion 118. Valve 102 also includes a base portion 120 with arms that extend into openings 108 in collar wall 106 to lock valve 102 in position within the collar. The cross sectional thickness of valve inner portion 116 decreases from the center to the periphery of the valve, while cylindrical outer valve portion 118 is of uniform thickness. Collar 104 completely encloses valve 106. Valve cartridge subassembly 100 has the advantage that the subassembly can be handled by automated assembly equipment without damaging the relatively soft material of the valve body. The inner surface geometry of collar 104 can be readily controlled for enhanced sealing performance. Valve cartridge subassembly 100 may be held in position within piston 44 by the force of spring 60 (or spring 98). Alternatively, flange 110 can be press fitted within the outlet passage of the piston to form a valve cartridge/piston subassembly during the assembly operation. Tulip-type inlet valve 88 (FIGS. 6–7) may also be provided in the form of a valve cartridge subassembly.

Figure 12:
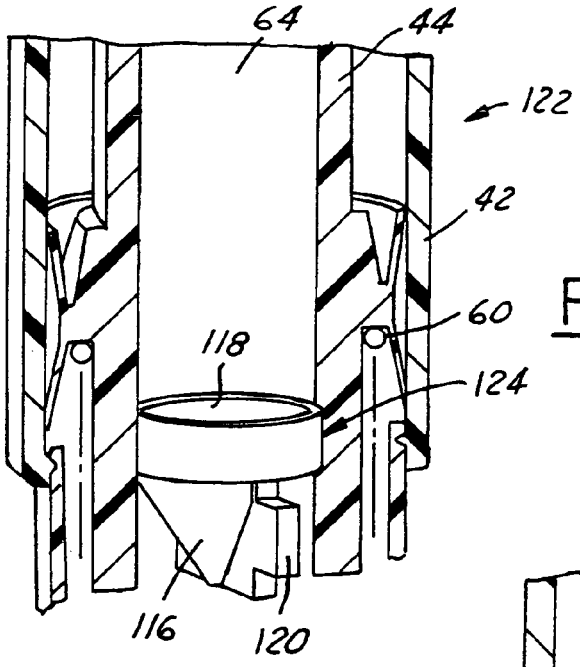
FIG. 12 is a fragmentary partially sectioned perspective view similar to that of FIG. 8 but showing another modified embodiment of the outlet check valve in accordance with present invention.
Figure 13:
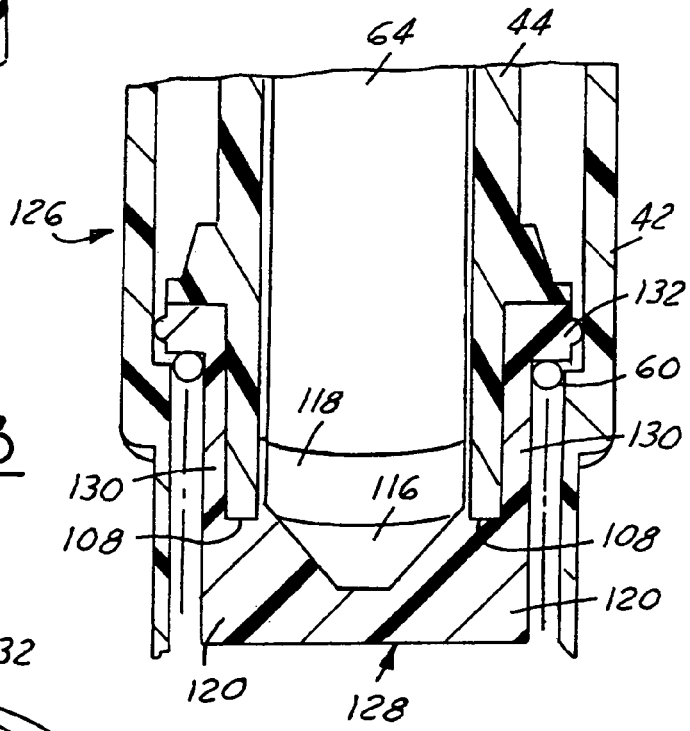
FIG. 13 is a fragmentary sectional view that illustrates a modification to the embodiment of FIG. 12.
Figure 14:
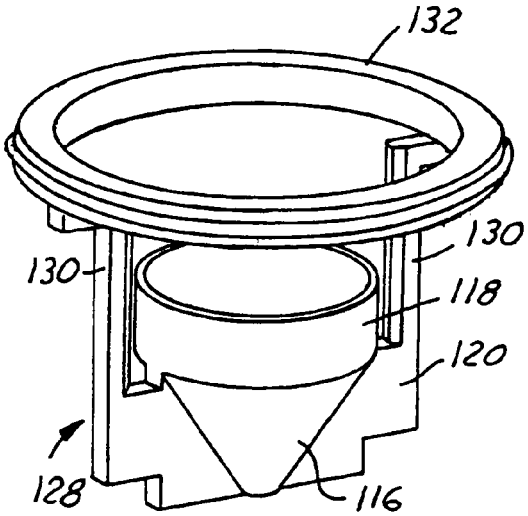
FIG. 14 is a perspective view of the outlet valve and seal in the embodiment of FIG. 13.

FIG. 12 illustrates a pump dispenser 122 in which outlet valve 124 is molded into the open lower end of pump piston 44. The lower end of the pump piston is provided with a pair of diametrically opposed openings, as with openings 108 in FIGS. 8–11, and valve 124 is molded into the lower end of the piston and locked within these openings. This embodiment not only protects valve 124 during storage and handling, but also eliminates the separate collar and subassembly in the embodiment of FIGS. 8–11. Inlet tulip-type valve 88 (FIGS. 6–7) may be likewise molded into opening 50. FIGS. 13 and 14 illustrate a pump dispenser 126 in which outlet valve 128 is molded into the lower end of piston 44, as in the embodiment of FIG. 12. However, a pair of legs 130 extend upwardly from the outer ends of valve anchor legs 120, molded through the piston openings, to an annular sealing ring 132 that extends around the outer periphery of piston 44. Sealing ring 132 is in opposed sliding sealing engagement in assembly with the inner surface of cylinder 42 to provide improved sealing against the inner cylinder surface. Valve 128 is shown in FIG. 14 separately from the lower end of the piston for purposes of illustration only, it being understood that valve 128 preferably, but not necessarily, is molded onto the lower end of the piston and not provided as a separate part in accordance with this aspect of the invention. In each of the embodiments of FIGS. 8–14, the valve is of integrally molded flexible resilient construction, preferably plastic, as previously discussed.

Figure 15:
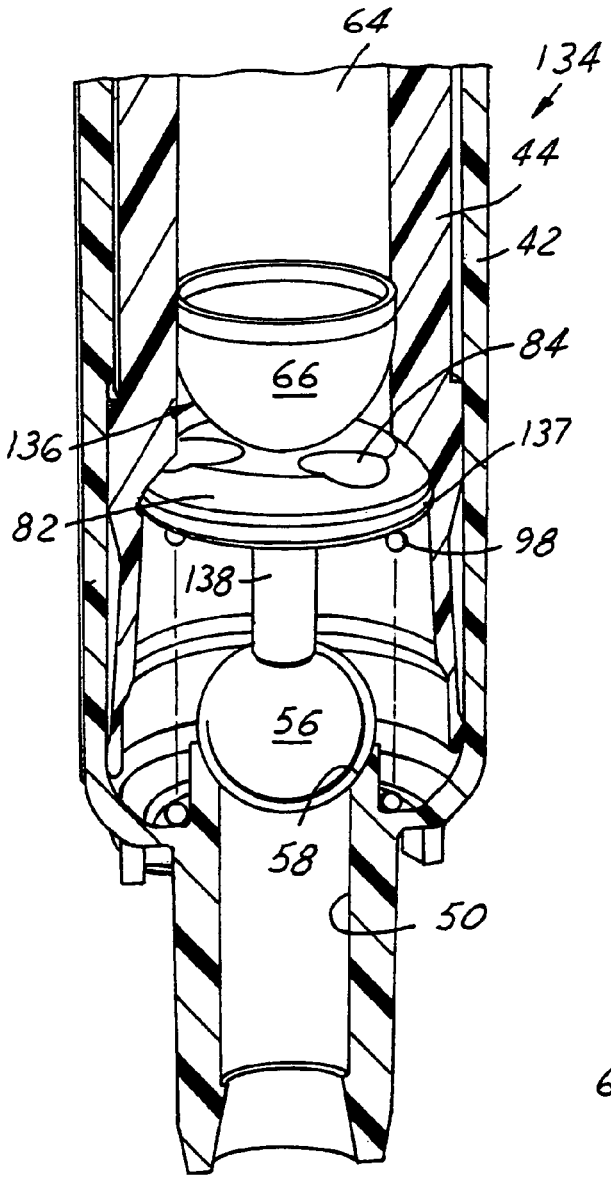
FIG. 15 is a fragmentary partially sectioned perspective view similar to that of FIG. 6 but showing another modified embodiment of the invention.
Figure 16:
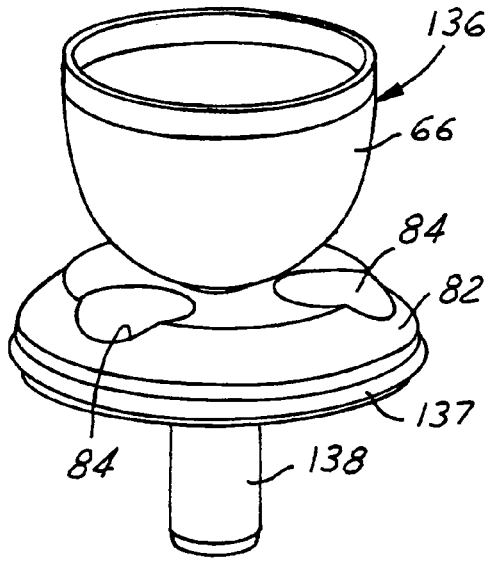
FIG. 16 is a perspective view of the outlet check valve in the embodiment of FIG. 15.
Figure 17:
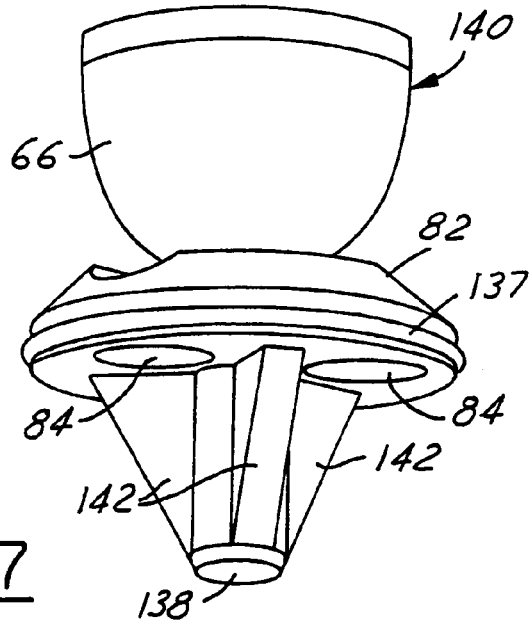
FIG. 17 is perspective view of a modification to the outlet check valve of FIGS. 15 and 16.

FIGS. 15 and 16 illustrate a pump dispenser 134 in accordance with another aspect of the invention. Outlet check valve 136 in the embodiment of FIGS. 15 and 16 includes a tulip-shaped valve body 66 and a base 82 similar to valve 80 in FIGS. 4 and 5. A bead 137 extends around the periphery of base 82 for sealing engagement with the opposed inner surface of piston 44. A finger 138 extends from the undersurface of base 82 coaxially with base 82 and valve body 66. In the fully depressed position of piston 44 within cylinder 42, finger 138 engages inlet valve ball 56 and holds the valve ball against its seat 58. Thus, spring 98 may be of less expensive construction than the contoured spring 60 of FIG. 1. FIG. 17 illustrates an outlet valve 140 that is a modification to valve 136 in FIGS. 15 and 16. Struts 142 extend from the undersurface of valve base 82 to finger 138 for strengthening the finger against bending when in opposed engagement with inlet valve ball 56 (FIG. 15). Valves 136 and 140 are of integrally molded flexible resilient construction, preferably plastic.

Figure 18:
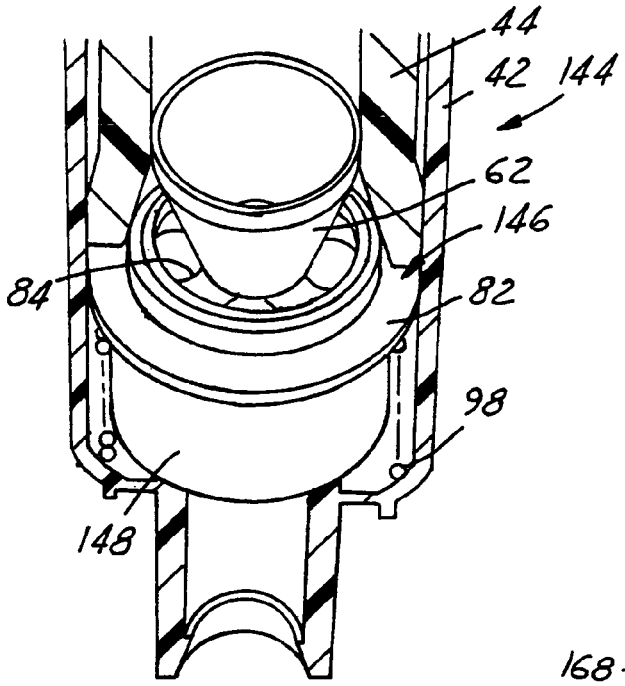
FIG. 18 is a fragmentary partially sectioned perspective view of an outlet check valve in accordance with another modified embodiment of the invention.
Figure 20:
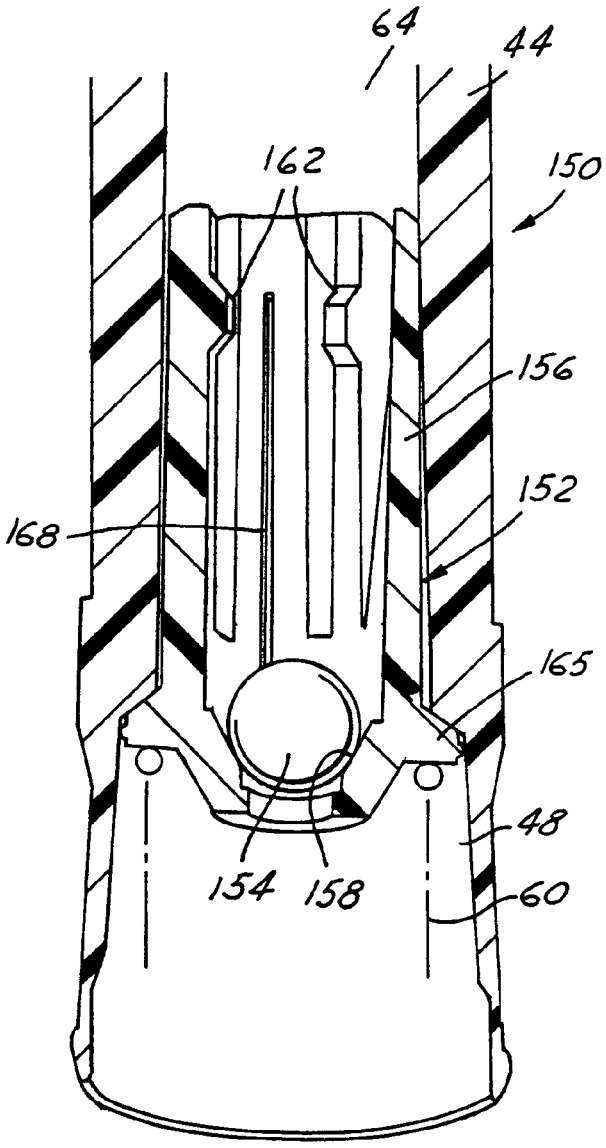
FIG. 20 is a perspective view that illustrates yet another outlet check valve arrangement in accordance with a further embodiment of the invention.
Figure 19:
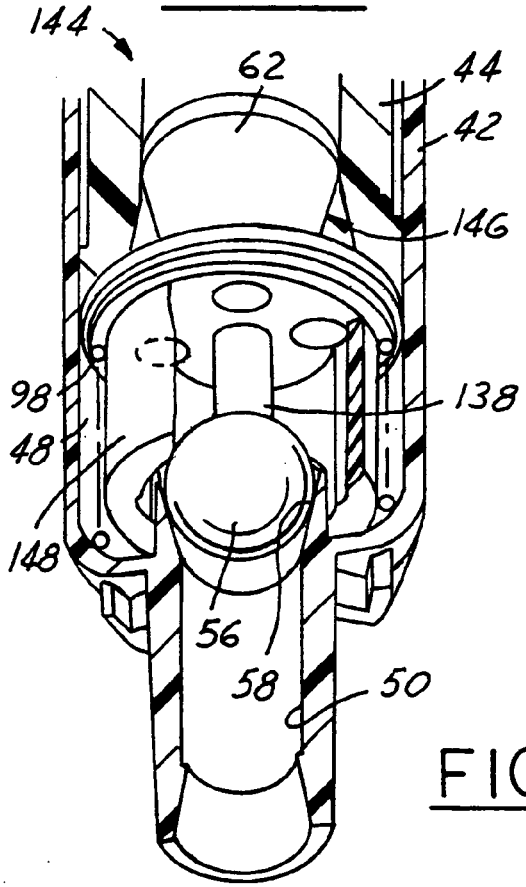
FIG. 19 is a fragmentary perspective view of the embodiment of the invention illustrated in FIG. 18.
Figure 21:
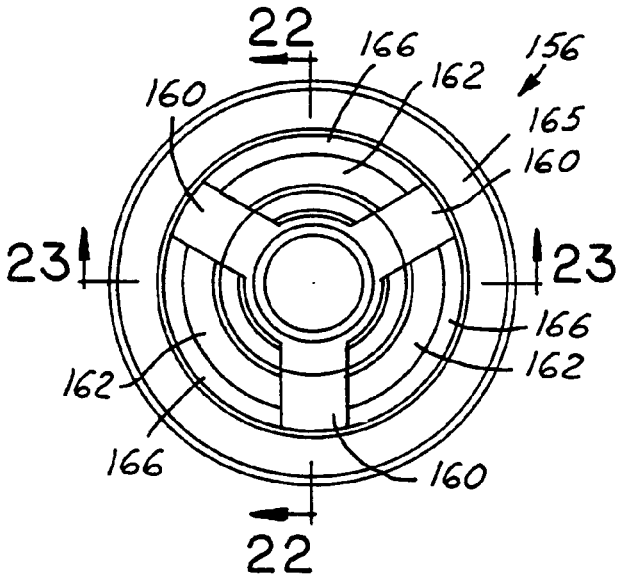
FIG. 21 is a top plan view of the outlet valve collar in the embodiment of FIG. 20.
Figure 23:
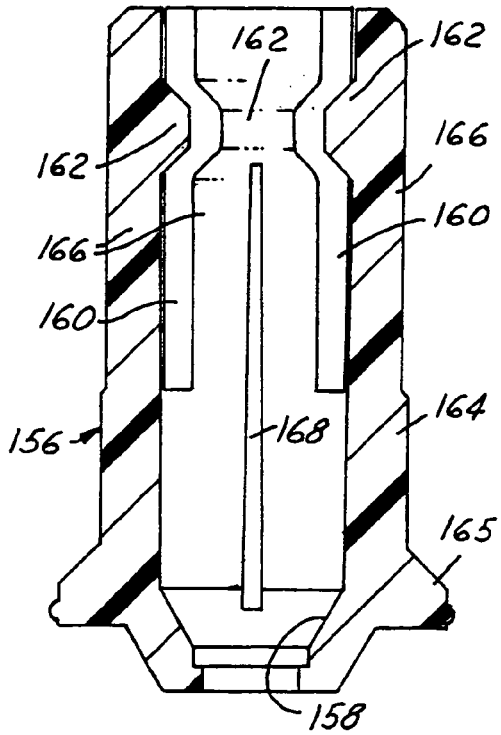
FIGS. 22 and 23 are sectional views taken substantially along the respective lines 22—22 and 23—23 in FIG. 21.
Figure 22:
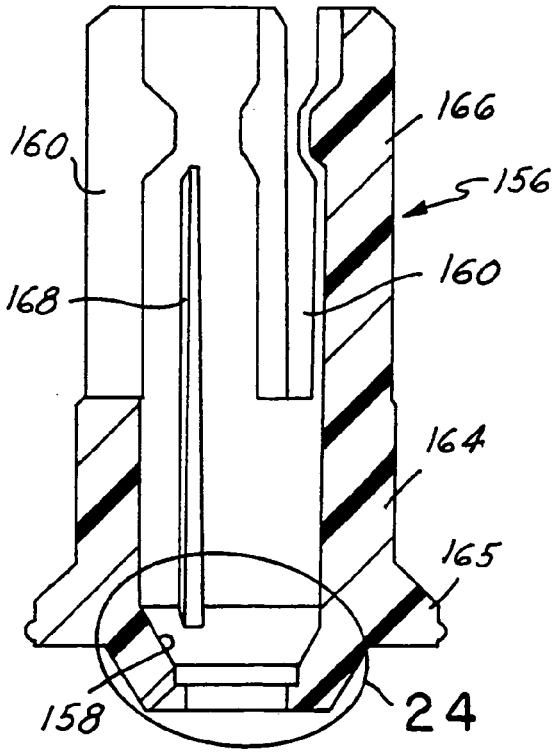
Figure 24:
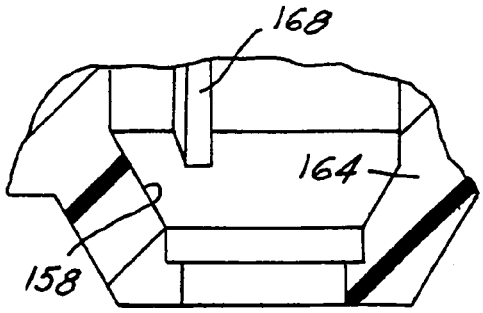
FIG. 24 is a fragmentary sectional view on an enlarged scale of the portion of FIG. 22 within the area 24.

FIGS. 18 and 19 illustrate a pump dispenser 144 having an outlet check valve 146. Valve 146 includes a valve body 62 having a circular base 82 with through-passages 84. A finger 138 extends from the undersurface of base 82 for engagement with inlet valve ball 56 as in FIG. 15. An annular cylindrical collar 148 also extends from the undersurface of valve base 82 surrounding valve ball 56 and valve seat 58. The dual purposes of collar 148 are to help hold valve ball 56 in position against seat 58 when the package is inverted, and to reduce the open internal volume of pump chamber 48 when the piston is fully depressed. This helps reduce the amount of air within the pump chamber that must be displaced by liquid to prime the pump.

FIGS. 20–24 illustrates a pump dispenser 150 that includes an outlet valve 152 in the form of a cartridge subassembly having a valve ball 154 and an integrally molded one-piece plastic collar 156. Collar 156 includes an annular base portion 164 from which a plurality of circumferentially spaced legs 166 axially extend. Axial fluid flow passages 160 are formed between legs 166. Each leg 166 has a radially inwardly extending lug or finger 162, which are collectively disposed in plane perpendicular to the axis of the collar, and which collectively form a stop to capture ball 154 within the collar. A valve seat 158 is formed around the lower end of collar base portion 164. A rib 168 extends axially along each leg 166 into base portion 164, and projects radially inwardly into the collar. The radially inner edges of ribs 168 are on a surface of revolution of greater diameter than the diameter of ball 154 to prevent ball 154 from blocking passages 160. It will be noted in FIGS. 22 and 23 that fingers 162 are spaced from the upper end of collar 156 to provide a recessed area for locating ball 154 prior to snapping the ball into the collar. Fingers 162 have angulated upper surfaces to cam the legs of the collar radially outwardly during insertion of the ball, resiliency of the legs returning the legs to their initial positions to capture the ball. Collar 156 includes a radially extending flange 165 with a radial seal for sealing against the opposing radial surface of chamber 48, as previously described. Flange 165 seats against the opposing axially facing surface of piston 44. Outlet valve cartridge subassembly 152 can be press fitted into outlet passage 64 of piston 44, or may be held in position by spring 60. When pump piston 44 is pushed downwardly, fluid forces ball 154 off of seat 158, so that the fluid can flow past the ball and through passages 160 to the outlet. Ribs 168 prevent ball 154 from blocking the passages. When the pump is released, the vacuum within the pump chamber pulls ball 154 against set 158 so that fluid can be drawn into the pump chamber through the inlet valve. Inlet ball-type valve 54 (FIG. 1) may also be provided as a cartridge subassembly.

There have thus been disclosed several embodiments of a pump dispenser for liquid products that fully satisfy all of the objects and aims previously set forth. The invention has been disclosed in connection with a number of presently preferred embodiments, and additional modifications and variations have been discussed. Other modification and variations will readily suggest themselves to persons of ordinary skill in the art. The invention is intended to embrace all such modifications and variations as fall within the spirit and broad scope of the appended claims.

The invention claimed is:

1. A pump dispenser for liquid products, which comprises:

a pump chamber including a cylinder, and a piston slidable within said cylinder and having an outlet passage extending through said piston, an inlet opening at an end of said chamber for receiving product to be dispensed, a spring within said chamber urging said piston to an extended position, an inlet check valve at said inlet opening to permit entry of product into said chamber as said piston is extended by said spring, but prevent exit of product from said chamber through said inlet opening as said piston is depressed against said spring, and an outlet check valve carried by said piston within said outlet passage to permit discharge of product from said chamber as said piston is depressed against said spring, wherein said outlet check valve comprises a concave valve body of flexible resilient construction opening away from said chamber and having an external periphery in radial surface-to-surface resilient sealing contact with an opposing radially inwardly facing wall surface of said outlet passage surrounding said valve.

2. The pump dispenser set forth in claim 1 wherein said outlet passage in said piston has a shoulder facing said chamber, and said outlet valve includes a base urged by said spring against said shoulder.

3. The pump dispenser set forth in claim 2 wherein said base of said valve has radial legs separated by gaps through which product flows from said chamber.

4. The pump dispenser set forth in claim 2 wherein said base of said valve is circular and has at least one through-opening through which product flows from said chamber.

5. The pump dispenser set forth in claim 2 wherein said valve body and said base are of integrally molded plastic construction.

6. The pump dispenser set forth in claim 1 wherein said valve body has an arcuate outer peripheral wall surface.

7. The pump dispenser set forth in claim 6 wherein said valve body tapers in cross sectional thickness to a minimum thickness at an outer periphery of said body in sealing contact with said opposing wall surface of said outlet passage.

8. The pump dispenser set forth in claim 1 wherein said valve body has a conical inner portion and a cylindrical outer portion in surface contact with said opposing wall surface.

9. The pump dispenser set forth in claim 8 wherein said inner portion of said valve body tapers in thickness to a minimum thickness at said outer portion.

10. The pump dispenser set forth in claim 1 further comprising a collar received within said piston, said collar having an internal cylindrical surface that forms part of said outlet passage, and wherein said outlet valve is molded as a subassembly into said collar.

11. The pump dispenser set forth in claim 10 wherein said outlet passage in said piston has a shoulder facing said chamber, and said outlet collar includes a radially outwardly extending flange seated against said shoulder.

12. The pump dispenser set forth in claim 11 wherein said spring engages said collar and urges said flange against said shoulder.

13. The pump dispenser set forth in claim 11 wherein said flange has a bead in sealing engagement with said shoulder.

14. The pump dispenser set forth in claim 11 wherein said flange has a peripheral bead in sealing engagement with an opposing wall surface of said piston.

15. The pump dispenser set forth in claim 10 wherein said collar has a cylindrical wall received within said piston and at least one opening extending through said wall, said valve having a portion extending into said wall opening for anchoring said valve to said collar.

16. The pump dispenser set forth in claim 1 wherein said outlet valve is molded onto said piston.

17. The pump dispenser set forth in claim 16 further comprising a resilient elastomeric seal molded externally of said piston, integrally with said valve, for sealed sliding engagement with said cylinder.

18. The pump dispenser set forth in claim 17 wherein said piston has at least two through-openings, and wherein said valve has portions extending through said through-openings to said seal for anchoring said valve to said piston.

19. The pump dispenser set forth in claim 1 wherein said inlet valve comprises a valve ball and a valve ball seat in said chamber, said spring being contoured to hold said valve ball against said seat when said piston is fully depressed against said spring.

20. The pump dispenser set forth in claim 1 wherein said inlet valve comprises a concave valve body of flexible resilient construction opening into said chamber and having a periphery in surface-to-surface resilient radial sealing contact with an opposing radially inwardly facing surface of said inlet opening.

21. The pump dispenser set forth in claim 20 wherein said inlet valve further includes a base extending from said inlet valve body and received in a support within said inlet opening for securing said inlet valve within said inlet opening.

22. The pump dispenser set forth in claim 21 wherein said inlet valve body tapers in radial thickness to a minimum thickness at said opposing wall surface of said inlet opening.

23. The pump dispenser set forth in claim 1 wherein said inlet valve comprises a valve ball and a valve ball seat at said inlet opening, and wherein said outlet valve includes a finger extending from said valve body for engaging said valve ball and holding said ball against said seat in a fully depressed position of said piston against said spring.

24. The pump dispenser set forth in claim 23 wherein said outlet passage in said piston has a shoulder facing said chamber, and said outlet valve includes a base urged by said spring against said shoulder.

25. The pump dispenser set forth in claim 24 wherein said outlet valve, including said base and said finger, are of integrally molded plastic construction.

26. The pump dispenser set forth in claim 25 wherein said outlet valve further includes struts extending from said base to said finger to support said finger with respect to said base.

27. The pump dispenser set forth in claim 23 wherein said outlet valve further includes a collar extending from said valve body for surrounding said valve ball in said fully depressed position of said piston against said spring, both to hold said ball in position and to reduce volume of said chamber.

28. The pump dispenser set forth in claim 27 wherein said outlet valve, including said base, said finger and said collar, are of integrally molded plastic construction.

29. A pump dispenser for liquid products, which comprises:

a pump chamber including a cylinder, and a piston slidable within said cylinder and having an outlet passage extending through said piston, an inlet opening at an end of said chamber for receiving product to be dispensed, a spring within said chamber urging said piston to an extended position, an inlet check valve at said inlet opening to permit entry of product into said chamber as said piston is extended by said spring, but prevent exit of product from said chamber through said inlet opening as said piston is depressed against said spring, and an outlet check valve carried by said piston within said outlet passage to permit discharge of product from said chamber as said piston is depressed against said spring, wherein one of said check valves comprises a valve cartridge subassembly in the associated opening, said valve cartridge subassembly comprising a collar including a valve seat surface and a valve element captured within said collar for sealing engagement within said valve seat surface.

30. The pump dispenser set forth in claim 29 wherein said one of said valve comprises said outlet valve, and wherein said collar has an internal cylindrical valve seat surface that forms part of said outlet passage in assembly with said piston, and said outlet valve comprises a concave outlet valve of flexible resilient construction that is molded onto said collar, said valve opening away from said chamber and having a periphery in radial surface-to-surface resilient sealing contact with said cylindrical valve seat surface of said collar.

31. The pump dispenser set forth in claim 30 wherein said outlet passage in said piston has a shoulder facing said chamber, and said outlet valve collar includes a radially outwardly extending flange seated against said shoulder.

32. The pump dispenser set forth in claim 31 wherein said spring engages said collar and urges said flange against said shoulder.

33. The pump dispenser set forth in claim 31 wherein said flange has a bead in sealing engagement with said shoulder.

34. The pump dispenser set forth in claim 31 wherein said flange has a peripheral bead in sealing engagement with an opposing wall surface of said piston.

35. The pump dispenser set forth in claim 30 wherein said collar has a cylindrical wall received within said piston and at least one opening extending through said wall, said valve having a portion extending into said opening for anchoring said valve to said collar.

36. The pump dispenser set forth in claim 29 wherein said collar has a sidewall with longitudinally extending passages, and said outlet valve comprises a valve ball.

37. The pump dispenser set forth in claim 36 wherein said collar has a ball valve seat facing away from said chamber against which said outlet valve ball seats, and radially inwardly extending fingers at an end of said collar remote from said seat to capture said ball within said collar.

38. The pump dispenser set forth in claim 37 wherein said outlet passage within said piston has a shoulder facing said chamber, and said collar has a radially outwardly extending flange seated against said shoulder.

39. The pump dispenser set forth in claim 38 wherein said spring engages said collar and urges said flange against said shoulder.

40. The pump dispenser set forth in claim 38 wherein said flange has a peripheral bead in sealing engagement with an opposing wall surface of said piston.

41. The pump dispenser set forth in claim 37 wherein said collar has a base portion in which said valve seat is disposed, legs extending from said base portion between which said passages are formed, and longitudinal ribs extending radially inwardly from said legs to capture said ball and prevent said ball from blocking said passages.

42. A pump dispenser for liquid products, which comprises:

a pump chamber including a cylinder, and a piston slidable within said cylinder and having an outlet passage extending through said piston, an inlet opening at an end of said chamber for receiving product to be dispensed, a spring within said chamber urging said piston to an extended position, an inlet check valve at said inlet opening to permit entry of product into said chamber as said piston is extended by said spring but prevent exit of product from said chamber as said piston is depressed against said spring, and an outlet check valve carried by said piston within said outlet passage to permit discharge of product from said chamber as said piston is depressed against said spring, wherein said inlet valve comprises a concave valve body of flexible resilient construction opening into said chamber and having a periphery in radial surface-to-surface resilient sealing contact with an opposing radially inwardly facing surface of said inlet opening.

43. The pump dispenser set forth in claim 42 wherein said outlet valve further includes a base extending from said valve body and received in a support within said inlet opening for securing said valve within said inlet opening.

44. The pump dispenser set forth in claim 43 wherein said inlet valve body tapers in thickness to a minimum thickness at said opposing wall surface of said inlet opening.

45. A pump dispenser for liquid products, which comprises:

a pump chamber including a cylinder, and a piston slidable within said cylinder and having an outlet passage extending through said piston, an inlet opening at an end of said chamber for receiving product to be dispensed, a spring within said chamber urging said piston to an extended position, an inlet check valve at said inlet opening to permit entry of product into said chamber as said piston is extended by said spring but prevent exit of product from said chamber as said piston is depressed against said spring, and an outlet check valve carried by said piston within said outlet passage to permit discharge of product from said chamber as said piston is depressed against said spring, said outlet valve being of flexible resilient plastic construction and being integrally molded onto said piston.

46. The pump dispenser set forth in claim 45 further comprising a resilient elastomeric seal molded externally of said piston, integrally with said valve, for sealed sliding engagement with said cylinder.

47. The pump dispenser set forth in claim 46 wherein said piston has at least two through-openings, and wherein said valve has portions extending through said openings to said seal for anchoring said valve to said piston.

48. The pump dispenser set forth in claim 45 wherein said outlet passage is cylindrical surrounding said outlet valve, and said outlet valve comprises a concave valve body that opens away from said chamber and having an external periphery in radial surface-to-surface resilient sealing contact with an opposing radially inwardly facing wall surface of said outlet passage.

49. A pump dispenser for liquid products, which comprises:

a pump chamber including a cylinder, and a piston slidable within said cylinder and having an outlet passage extending through said piston, an inlet opening at an end of said chamber for receiving product to be dispensed, a spring within said chamber urging said piston to an extended position, an inlet check valve at said inlet opening to permit entry of product into said chamber as said piston is extended by said spring but prevent exit of product from said chamber as said piston is depressed against said spring, and an outlet check valve carried by said piston within said outlet passage to permit discharge of product from said chamber as said piston is depressed against said spring, said inlet check valve comprising a valve ball and a valve seat at said inlet opening, said outlet check valve being of flexible resilient construction and having a finger extending into said chamber for engaging said valve ball and holding said valve ball against said seat in a fully depressed position of said piston against said spring.

50. The pump dispenser set forth in claim 49 wherein said outlet passage in said piston has a shoulder facing said chamber, and said outlet valve includes a base urged by said spring against said shoulder.

51. The pump dispenser set forth in claim 50 wherein said outlet valve, including said base and said finger, are of integrally molded plastic construction.

52. The pump dispenser set forth in claim 51 wherein said outlet valve further includes struts extending from said base to said finger to support said finger with respect to said base.

53. The pump dispenser set forth in claim 49 wherein said outlet valve further includes a collar extending from said valve for surrounding said valve ball in said fully depressed position of said piston against said spring, both to hold said ball in position and to reduce volume of said chamber.

54. The pump dispenser set forth in claim 53 wherein said outlet valve, including said base, said finger and said collar, are of integrally molded plastic construction.

55. The pump dispenser set forth in claim 54 wherein said outlet passage is cylindrical surrounding said outlet valve, and said outlet valve comprises a concave valve body that opens away from said chamber and having an external periphery in radial surface-to-surface resilient sealing contact with an opposing radially inwardly facing wall surface of said outlet passage.

56. A pump dispenser for liquid products, which comprises:

a pump chamber including a cylinder, and a piston slidable within said cylinder and having an outlet passage extending through said piston, an inlet opening at an end of said chamber for receiving product to be dispensed, a spring within said chamber urging said piston to an extended position, an inlet check valve at said inlet opening to permit entry of product into said chamber as said piston is extended by said spring but prevent exit of product from said chamber as said piston is depressed against said spring, and an outlet check valve carried by said piston within said outlet passage to permit discharge of product from said chamber as said piston is depressed against said spring, said inlet check valve including a valve ball and a valve ball seat at said inlet opening, said outlet check valve including a collar for surrounding said valve ball in the fully depressed position of said piston against said spring, both to hold said ball in position against said ball seat and to reduce volume of said chamber.

57. The pump dispenser set forth in claim 56 wherein said outlet passage is cylindrical surrounding said outlet valve, and said outlet valve comprises a concave valve body that opens away from said chamber and having an external periphery in radial surface-to-surface resilient sealing contact with an opposing radially inwardly facing wall surface of said outlet passage.

58. The pump dispenser set forth in claim 57 wherein said outlet passage in said piston has a shoulder facing said chamber, and said outlet valve includes a base urged by said spring against said shoulder.

59. The pump dispenser set forth in claim 58 wherein said outlet valve, including said base, said finger and said collar, are of integrally molded plastic construction.

60. A pump dispenser for liquid products, which comprises:

a pump chamber including a cylinder, and a piston slidable within said cylinder and having an outlet passage extending through said piston, an inlet opening at an end of said chamber for receiving product to be dispensed, a spring within said chamber urging said piston to an extended position, an inlet check valve at said inlet opening to permit entry of product into said chamber as said piston is extended by said spring but prevent exit of product from said chamber as said piston is depressed against said spring, and an outlet check valve carried by said piston within said outlet passage to permit discharge of product from said chamber as said piston is depressed against said spring, at least one of said check valve comprising a valve cartridge subassembly that includes a valve ball and a collar within which said valve ball is captured.

61. The pump dispenser set forth in claim 60 wherein said collar is of one-piece integrally formed construction, and includes a base portion with a valve ball seat and a circumferentially array of legs extending from said base portion, spaces between said legs forming passages for flow of fluid when said valve ball is spaced from said seat.

62. The pump dispenser set forth in claim 61 wherein said collar further includes fingers extending radially inwardly from said legs at positions spaced from said seat to capture said ball within said collar.

63. The pump dispenser set forth in claim 62 wherein said fingers have surfaces remote from said seat that are angulated toward said seat to assist insertion of said ball into said collar by camming said legs radially outwardly.

64. The pump dispenser set forth in claim 63 where said fingers are spaced from ends of said legs remote from said seat.

65. The pump dispenser set forth in claim 62 wherein said collar further includes ribs that extend along internal surfaces of said fingers to space said ball from said passages.

* * * * *